US006911943B2

(12) United States Patent
Ryou et al.

(10) Patent No.: US 6,911,943 B2
(45) Date of Patent: Jun. 28, 2005

(54) ANTENNA FOR PORTABLE WIRELESS COMMUNICATION APPARATUSES

(75) Inventors: Byung-Hoon Ryou, Kyonggi-do (KR); Weon-Mo Sung, Kwangju (KR)

(73) Assignee: E.M.W. Antenna Co., Ltd., Uiwang-si (KR)

( * ) Notice: Subject to any disclaimer, the term of this patent is extended or adjusted under 35 U.S.C. 154(b) by 0 days.

(21) Appl. No.: 10/481,509

(22) PCT Filed: Jun. 27, 2002

(86) PCT No.: PCT/KR02/01228

§ 371 (c)(1),
(2), (4) Date: Dec. 19, 2003

(87) PCT Pub. No.: WO03/003511

PCT Pub. Date: Jan. 9, 2003

(65) Prior Publication Data

US 2004/0189536 A1 Sep. 30, 2004

(30) Foreign Application Priority Data

Jun. 27, 2001 (KR) ..... 2001/36872
Aug. 21, 2001 (KR) ..... 2001/50237

(51) Int. Cl.[7] ..... H01Q 1/24
(52) U.S. Cl. ..... 343/702; 343/725
(58) Field of Search ..... 343/702, 725, 343/900, 901, 767, 770

(56) References Cited

U.S. PATENT DOCUMENTS 6,069,592 A * 5/2000 Wass ..... 343/895
6,219,008 B1 4/2001 Ryou et al. ..... 343/906
6,310,578 B1 * 10/2001 Ying ..... 343/702
6,556,171 B2 * 4/2003 Gillon et al. ..... 343/702

FOREIGN PATENT DOCUMENTS

KR 2000-0001484 1/2000

OTHER PUBLICATIONS

'Radiation by cavity–backed antennas on a circular cylinder' L.C. Kempel, IEE Proc.—Microw. Antennas Propag., vol. 142, No. 3, P233–239, Jun. 1995.

'A Slot–Array Antenna on a Cozxial Cylinder', Kyouichi IIGUSA, IEEE Antenna Propogation Symposium, p. 1434–1437.

'An Array Antenna of Slotted Cylinder for Land Mobile Base Station', Jiro Hirokawa, IEEE Antenna and Propagation Symposium, p. 1061–1064, 1992.

* cited by examiner

*Primary Examiner*—Hoang V. Nguyen
(74) *Attorney, Agent, or Firm*—Dellett & Walters

(57) ABSTRACT

Disclosed herein is an antenna for portable wireless communication apparatuses. The antenna for portable wireless communication apparatuses includes an antenna element provided on its outer surface with a conductor on which a plurality of openings are formed. The outer portion of the interior of the conductor is filled with a dielectric material. This antenna element is connected in parallel with a linear radiator in an insulated state, thereby radiating electromagnetic waves and at the same time being capable of adjusting the radiated amount and direction of the electromagnetic waves.

12 Claims, 10 Drawing Sheets

ANTENNA FOR PORTABLE WIRELESS COMMUNICATION APPARATUSES

BACKGROUND OF THE INVENTION

1. Field of the Invention

The present invention relates generally to an antenna for portable wireless communication apparatuses, and more particularly to an improved antenna for the prevention of harm to users by electromagnetic waves generated by portable wireless communication apparatuses.

2. Description of the Prior Art

Today, mobile phones and other wireless apparatuses have been widely used due to the development of the communication service, and such communication apparatuses can be used everywhere by means of wireless communication technology.

In general, communication can mainly be classified into wire communication and wireless communication. In the case of wireless communication, there are needed a transmitter for transmitting electromagnetic waves, an antenna for receiving the electromagnetic waves transmitted from the transmitter, and a receiver for receiving the electromagnetic waves from the antenna.

The transmitter-receiver and the antenna are installed on the body of the communication apparatus. Since these devices, such as the transmitter-receiver and the antenna, have become smaller and lighter, the communication apparatuses including these device have been miniaturized.

The antenna can be classified according to the operation method of a linear radiator and a helical antenna part in which the radiating directions of the electromagnetic waves are non-directional. That is, the antennas are mainly classified into three types, that is, a retractable type, a fixed type and a top mounted-helical type. In the retractable type of antenna, the helical antenna part 100 is fixed to the housing and the linear radiator 200 can move up and down in the helical antenna part 100, as shown in FIG. 10*a*. In the fixed type of antenna, both helical antenna part 100 and linear radiator 200 are fixed to the housing, as shown in FIG. 10*b*. In the top mount-helical type of antenna, the helical antenna part 100 is installed on top of the linear radiator 200, as shown in FIG. 10*c*.

As described above, if the helical antenna part in which the radiating directions of electromagnetic waves are non-directional is used, the antenna has direct harmful effects on the user of the wireless communication apparatuses. The electromagnetic waves of the antenna include direct waves, reflected waves and diffracted waves. All these waves do harm to people, and above all the direct waves are the most harmful.

A conventional electromagnetic waves intercepting system encloses a circuit substrate mounted in the communication apparatus so as to prevent the electromagnetic waves from leaking to the outside. This conventional electromagnetic waves intercepting system has a problem in that the electromagnetic waves leak to the outside through an antenna connecting hole which is formed in the electromagnetic waves intercepting system.

That is, this conventional electromagnetic waves intercepting system includes the hole in which the antenna connector is installed so as to ground the antenna exposed to the outside on the circuit substrate of the communication apparatuses. When the antenna connector is connected to the hole, the hole is not completely sealed due to the tolerance of the hole.

According to another conventional method for intercepting electromagnetic waves, a filter material for intercepting the electromagnetic waves is coated onto the inside of the casing so as to intercept the electromagnetic waves.

However, since the conventional wireless antenna is positioned on the upper side of the casing of the communication apparatuses and is pulled from a guide protrusion to make a phone call, the electromagnetic waves radiated when using the communication apparatuses are directly transmitted to the head of the user. Thus, the health of the user becomes worse because the direct waves, the reflected waves and the diffracted waves have a direct negative influence upon the head of the user.

SUMMARY OF THE INVENTION

Accordingly, the present invention has been made keeping in mind the above problems occurring in the prior art, and an object of the present invention is to provide an antenna for portable wireless communication apparatuses, which is comprised of an antenna element for providing electromagnetic waves directional properties, replacing the conventional helical antenna part for generating non-directional electromagnetic waves, and a linear radiator supplied with power and connected in parallel with the antenna element, thereby preventing the electromagnetic waves generated by portable wireless communication apparatuses from doing harm to people, and increasing the efficiency of the antenna.

In order to accomplish the above object, there is provided an antenna for portable wireless communication apparatuses including an antenna element, which is provided on its outer surface with a conductor on which a plurality of openings are formed, provided on the inner portion of the conductor with a dielectric material, and connected in parallel with a linear radiator in an insulated state, thereby radiating electromagnetic waves and at the same time being capable of adjusting the radiated amount and direction of the electromagnetic waves.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
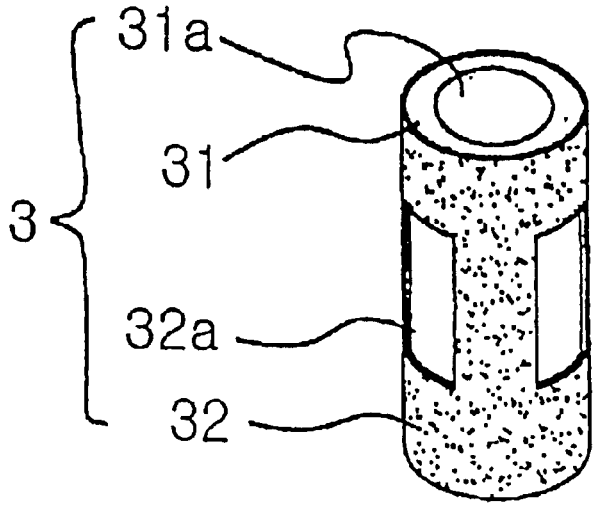
FIG. 1 is a perspective view showing an antenna element of the present invention.

Reference now should be made to the drawings, in which the same reference numerals are used throughout the different drawings to designate the same or similar components.

Figure 2:
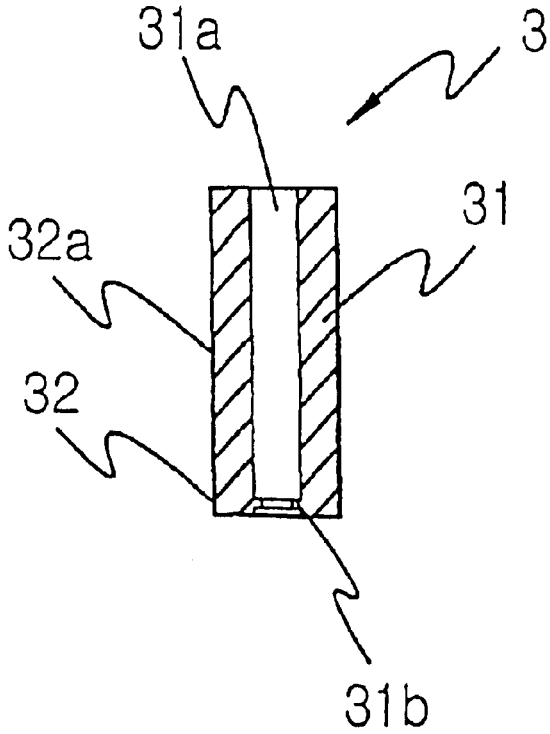
FIG. 2 is a longitudinal section of the antenna element of FIG. 1.

As shown in FIGS. 1 and 2, an antenna element 3 of the present invention is cylindrical-shaped and includes on its outer surface a conductor 32 in which a plurality of openings 32*a* are formed at desired intervals. The outer portion of the interior of the conductor 32 is filled with a dielectric material 31. A hollow portion 31*a* surrounded with the dielectric material 31 includes a stepped portion 31*b* on the bottom portion thereof, with the stepped portion 31*b* being provided with a hole to supply a linear radiator 2 with power. The antenna element 3 is installed at the position where a helical antenna part is conventionally installed.

Figure 3:
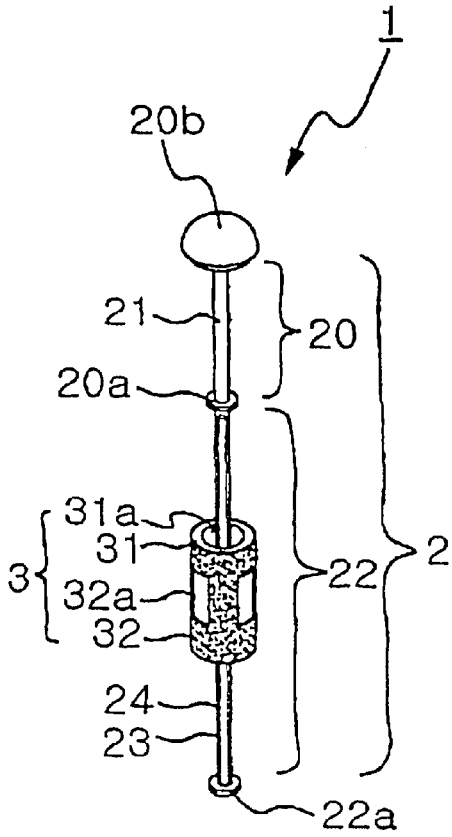
FIG. 3 is a perspective view showing the installation of the antenna element.

As shown in FIGS. 3 and 4, the linear radiator 2 includes the first radiator part 20 and the second radiator part 22 linked together in a row in a capacitive connecting manner. The first radiator part 20 is relatively short in length and inserted into the antenna element 3 longitudinally. The first radiator part 20 consists of a dielectric cap 20*b* on its top portion, a power supply terminal 20*a* on its bottom portion and a rod 21 connecting the dielectric cap 20*b* with the power supply terminal 20*a*, with the rod 21 being made of a conductive material. The second radiator part 22 is longer than the first radiator part 20. This second radiator part 22 consists of a rod 23 covered with a dielectric material 24 and the power supply terminal 22*a*. The rod 23 is a conductor as a rod 21 of the first radiator part 20, and is aligned with the rod 21.

Although in this embodiment there is employed the linear radiator 2 consisting of a plurality of rods, there can be employed a linear radiator 2 in which a plurality of rods are integrated into a single body. In the meantime, the linear radiator 2 and the antenna element 3 are fixedly attached to the housing while the linear radiator 2 can be inserted into the antenna element 3, or the antenna element 3 can be fixedly attached to the upper portion of the linear radiator 2.

In this present embodiment, the dielectric material 31 is surrounded with the conductor 32. Preferably, the dielectric material 31 can be plated with metal or coated with a printed circuit substrate in place of the conductor 32, thereby being capable of reducing the weight and size of the antenna, being convenient to manufacture and reducing the manufacturing cost of the antenna.

Figure 5A:
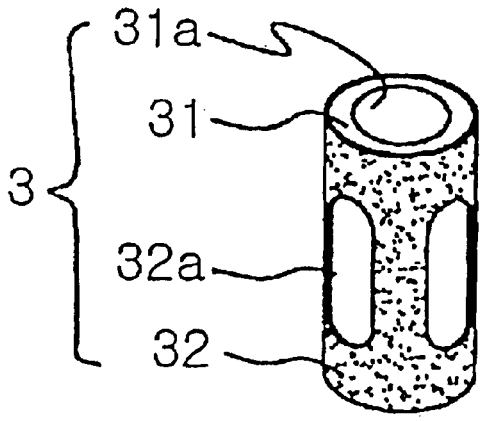
FIGS. 5*a* to 5*e* are perspective views showing the variations of the antenna element.
Figure 5B:
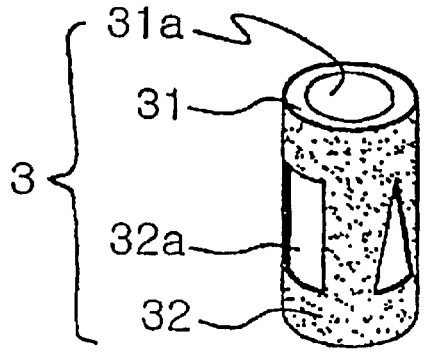
Figure 5C:
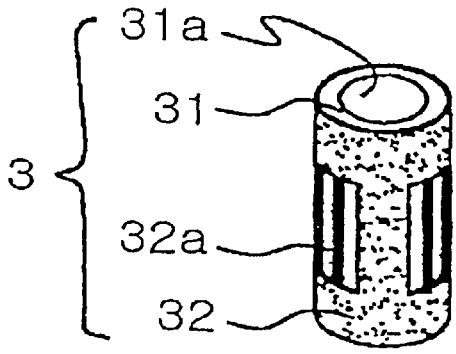

The openings 32*a* may be rectangular-shaped, as shown in FIG. 1. However, the openings 32*a* having one of the elongated-shape and triangular-shape may be formed at desired intervals around the antenna element 3, as shown in FIGS. 5*a* and 5*b*. Also, each opening 32*a* may be divided into a plurality of parts each having one of elongated, rectangular or triangular-shape, with a plurality of openings 32*a* being formed around the antenna element 3 at desired intervals, as shown in FIG. 5*c*.

Figure 5D:
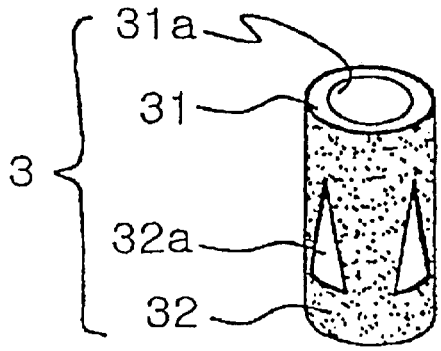
Figure 5E:
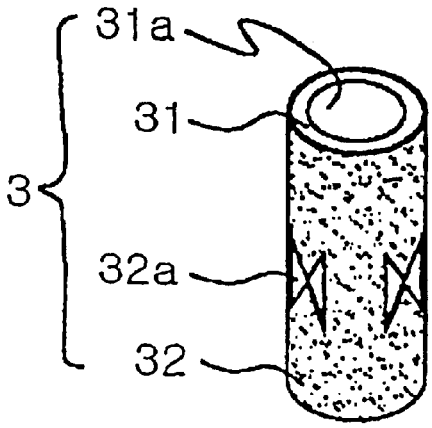

The openings 32*a* may be butterfly-shaped, as shown in FIG. 5*e*, and may have two or more different shapes regularly spaced apart from each other, as shown in FIG. 5*d*. In this way, the openings 32*a* can be varied in form so as to adjust the electrical characteristics of the antenna.

The operation and effect of the antenna of the present invention will be described with reference to the retractable-type antenna shown in FIGS. 4*a* and 4*b*.

The operation of the antenna of the present invention is described in the following when the linear radiator 2 moves up and down in the antenna element 3, a principal element of the present invention.

Figure 4A:
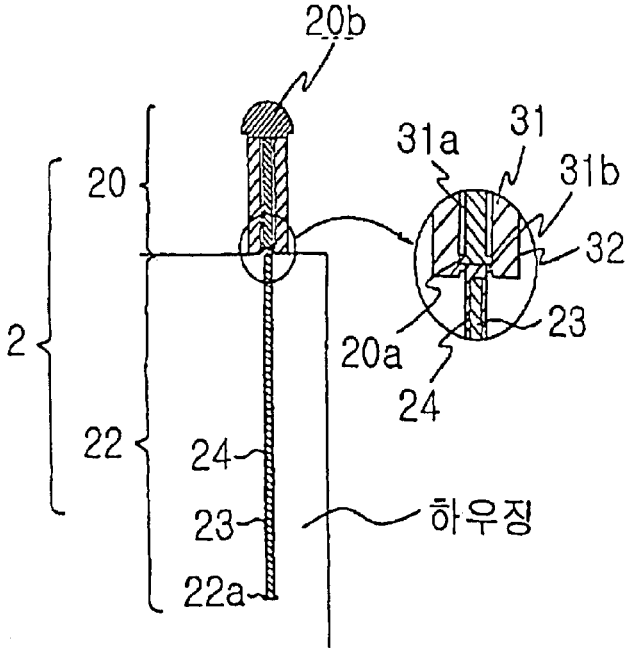
FIG. 4*a* is a cross section showing a powered linear radiator retracted into the housing through the antenna element.

When the Linear Radiator is Retracted (refer to FIG. 4*a*)

When the linear radiator 2 passing through the antenna element 3 fixed to the housing is retracted into the housing, the linear radiator 2 is inserted into the housing and is extended through the antenna element 3.

Figure 6:
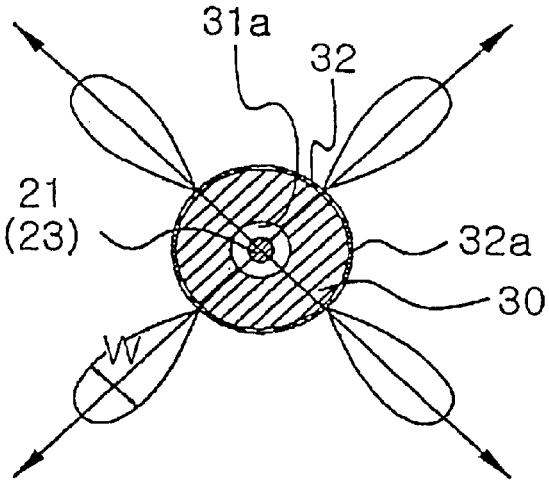
FIG. 6 is a view showing an example of the radiating directions of electromagnetic waves of the antenna with the antenna element of the present invention.

At this time, the first radiator part 20 is supplied with power and resonated with the antenna element 3. Specifically, the power supply terminal 20*a* formed on the bottom of the rod 21 of the first radiator part 20 is inserted into the hole of the stepped portion 31*b* to be supplied with power through the supply power terminals 20*a*, 22*a* of the linear radiator 2. Thus the first radiator part 20 is electrified and resonated. In this case, the radiated electromagnetic waves have directional properties by means of the openings 32*a* formed on the conductor 32, as shown in FIG. 6.

Figure 4B:
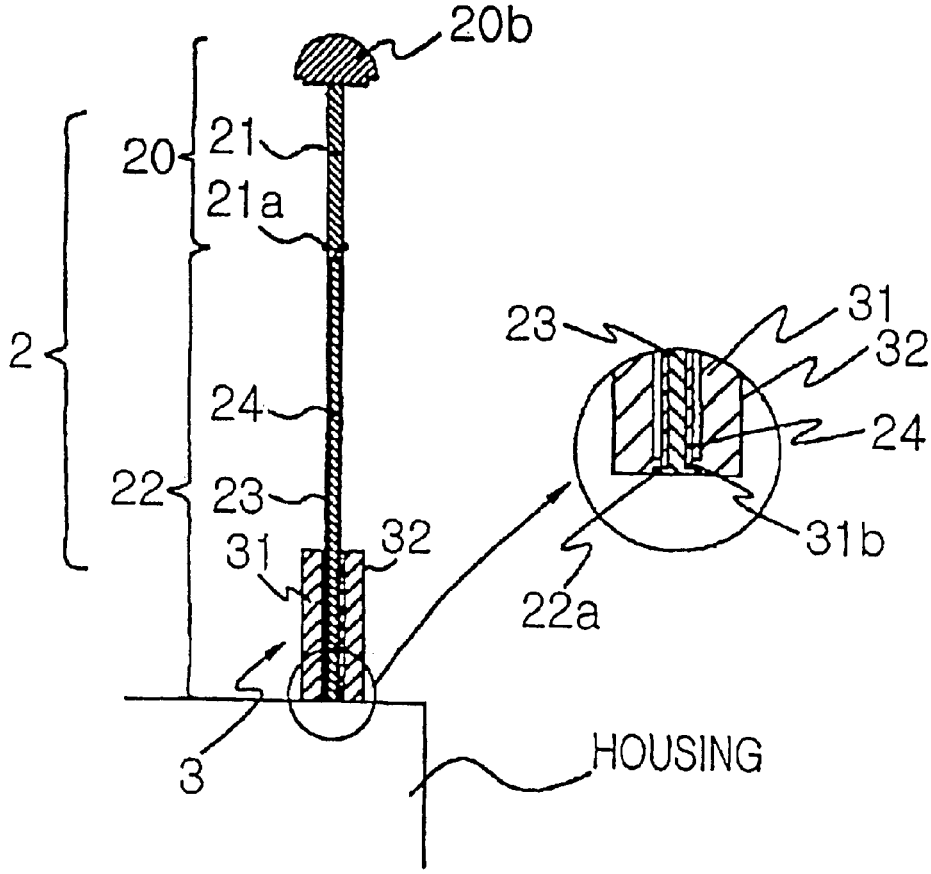
FIG. 4*b* is a cross section showing the powered linear radiator extended from the housing through the antenna element.

When the Linear Radiator is Extended (refer to FIG. 4*b*)

When the linear radiator 2 is extended out of the housing, the first radiator part 20 is separated from the antenna element 3, and at the same time the rod 23 covered with the dielectric material 24 of the second radiator part 22, which is connected with the first radiator part 20 in a capacitive coupling manner, is partially vertically extended from the antenna element 3 through the hollow portion 31*a* of the antenna element 3.

At this time, the power supply terminal 22*a* formed on the bottom of the rod 23 of the second radiator part 22 is inserted into the hole of the stepped portion 31*b* to be supplied with power through the supply power terminals 20*a*, 22*a* of the linear radiator 2. Thus the second radiator part 22 is electrified and resonated. In this case, the radiated electromagnetic waves have directional properties by means of the openings 32*a* formed on the conductor 32, as shown in FIG. 6.

Therefore, the linear radiator 2 is always grounded with the stepped portion 31*b* of the dielectric material 31 through the power supply terminals 20*a* and 22*a* of the first and second radiator parts 20 and 22 passing through the stepped portion 31*b* of the dielectric material 31, when retracted and extended. Though the stepped portion 31*b* of the dielectric material 31 is grounded with the power supply terminals 20*a* and 22*a* of the linear radiator 2, there is not a power supply point between the antenna element 3 and the linear radiator 2, that is, power is not supplied between the antenna element 3 and the linear radiator 2.

When the radiated electromagnetic waves have directional properties as shown in FIG. 6, the width W of the beam can be adjusted by the area, shape, position and number of the openings 32*a*.

Figure 7A:
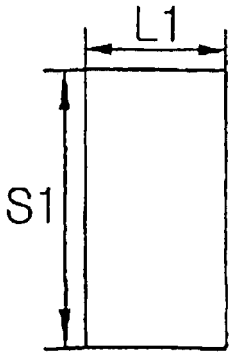
FIGS. 7*a* and 7*b* are views showing two openings having different areas.
Figure 7B:
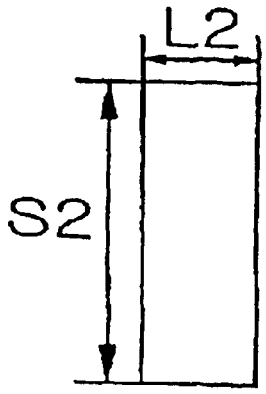
Figure 7C:
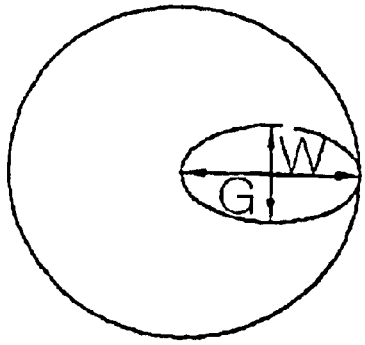
FIGS. 7*c* and 7*d* are views showing the directional characteristics of two openings having different areas, shown in FIGS. 7*a* and 7*b;*
Figure 7D:
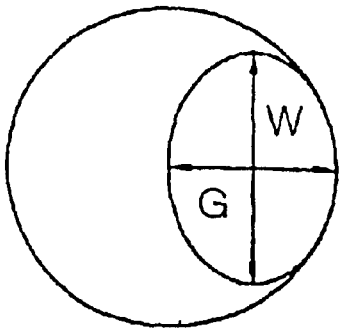

The relation between the adjustment of the width W of the beam and the gain due to its adjustment is described in the following. As shown in FIGS. 7*a* and 7*b*, two openings 32*a* are equal to each other in terms of the shape and position but different from each other in terms of area. That is, when the length of the opening 32*a* is represented by S and its width is represented by L, the lengths S1 and S2 of two openings 32*a* are equal to each other and the width L1 of one opening 32*a* shown in FIG. 7*a* is longer than L2 of the other opening 32*a* shown in FIG. 7*b*, the width W of the beam gets smaller, as the area of the opening 32*a* gets larger, as shown in FIGS. 7*c* and 7*d*, thereby allowing the electromagnetic waves to have directional properties.

Figure 8A:
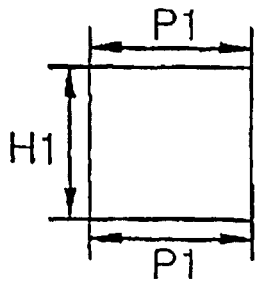
FIGS. 8*a* and 8*b* are views showing the openings equal to each other in length and width but different from each other in form.
Figure 8B:
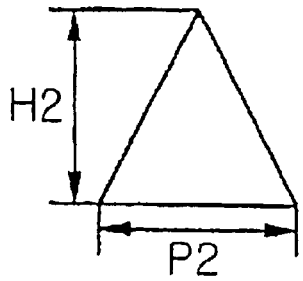

The case where the openings 32*a* are equal to each other in terms of area and position but different from each other in terms of shape, will be described in the following with reference to FIGS. 8*a* and 8*b*. When the height of the opening 32*a* is represented by H and its width is represented by P, the height H1 of the opening 32*a* of FIG. 8*a* is equal to the height H2 of the opening FIG. 8*b* and further the width P1 of the opening of FIG. 8*a* is equal to the width P2 of the opening FIG. 8*b*, the shape of the beam of the rectangular opening of FIG. 8*a* is shown in FIG. 8*c* and the shape of the beam of the triangular opening of FIG. 8*b* is shown in FIG. 8*d*.

Figure 8C:
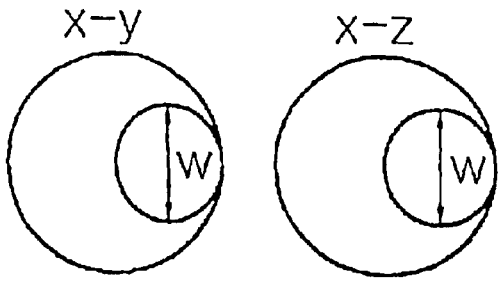
FIGS. 8*c* and 8*d* are views showing the directional characteristics of the openings having different shapes, shown in FIGS. 8*a* and 8*b;*
Figure 8D:
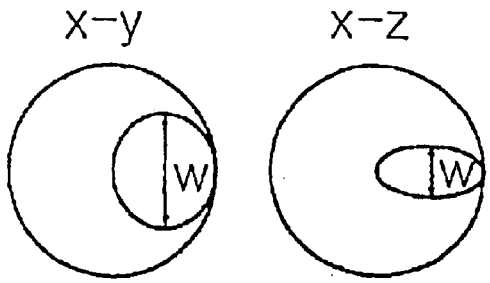
Figure 8E:
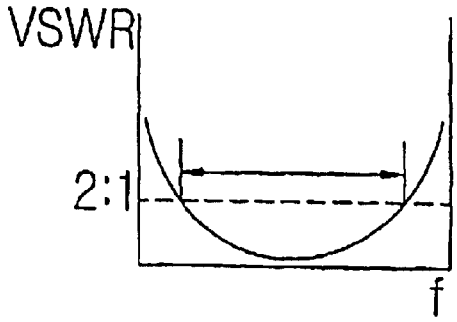
FIGS. 8*e* and 8*f* are graphs showing the band widths of the openings having different shapes, shown in FIGS. 8*a* and 8*b;*
Figure 8F:
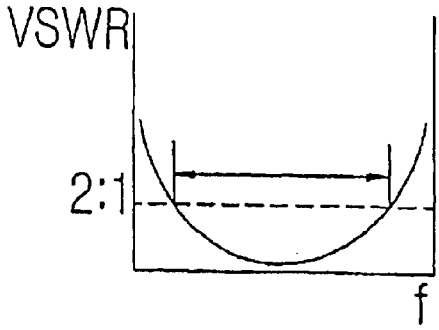

As shown in FIGS. 8*c* and 8*d*, the widths W of the beams are equal or similar to each other on the x-y line, whereas the shapes thereof are different from to each other on the x-z line. In this manner, the shape of the beam can be varied. The width of the band is narrow when the opening 32*a* is rectangular in shape, as shown in FIG. 8*e*, whereas the width of the band is wide when the opening 32*a* is triangular in shape as shown in FIG. 8*f*. Accordingly the width of the band can be adjusted, and thus problems due to polarized wave synchronization and the reflected waves of the antenna can be solved.

By changing the position of the opening 32*a*, the radiating direction of the beam can be adjusted in the desired direction. For example, in the case where the electromagnetic waves are non-directional, the electromagnetic waves are transmitted to the user of the wireless communication apparatuses, even though the upper portion of the antenna is modified. However, when the direction of the electromagnetic waves are changed by moving the passive antenna or the openings 32*a* according to the present invention, the direction of the radiation of the electromagnetic waves transmitted to the user of the wireless communication apparatuses can be changed and/or adjusted.

Figure 9A:
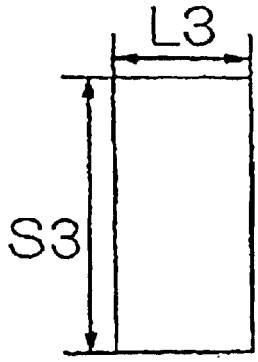
FIGS. 9*a* and 9*b* are views showing the openings similar to each other in form and different from each other in number and area.
Figure 9B:
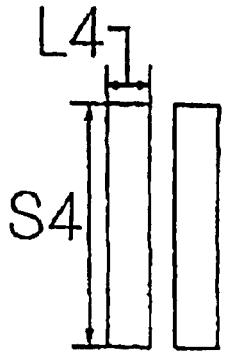
Figure 9C:
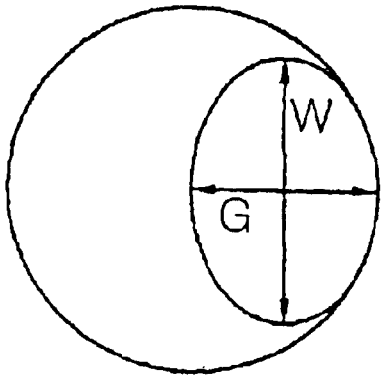
FIGS. 9*c* and 9*d* are views showing the directional characteristics of the openings shown in FIGS. 9*a* and 9*b; and*
Figure 9D:
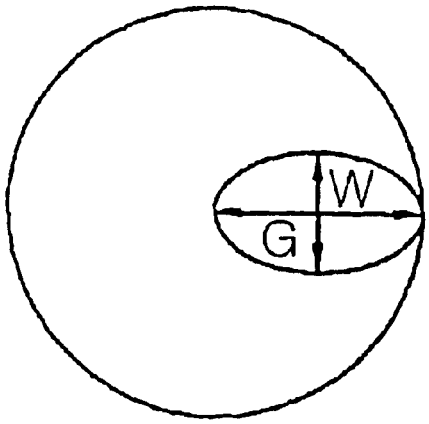

The shape of the beam according to the number of openings 32*a* is illustrated in FIGS. 9*a* to 9*d*. Taking the rectangular opening 32*a* as an example, when the length of the opening 32*a* is represented by S and the width thereof is represented by L, the S3 of FIG. 9*a* is equal to the S4 of FIG. 9*b*, and L3 of FIG. 9*a* is longer than L4 of FIG. 9*b*. As shown in FIG. 9*a*, the adjustment of the width W of the beam with one wider opening 32*a* is restricted within a limited range. On the contrary, when the width W of the beam is adjusted with divided openings 32*a* having the width L4 respectively, as shown in FIG. 9*b*, the width W of the beam can be adjusted to be narrower than that when using one wider opening 32*a*. The butterfly-shaped opening 32*a* of FIG. 5*e* is an example to which this principle is applied.

Since the gain and the radiating characteristics of the antenna are varied depending on the shape, area, position and number of the openings 32*a*, the radiating direction and radiating amount of the electromagnetic waves are adjusted by varying the shape, area, position and number of the openings 32*a*.

Figure 10A:
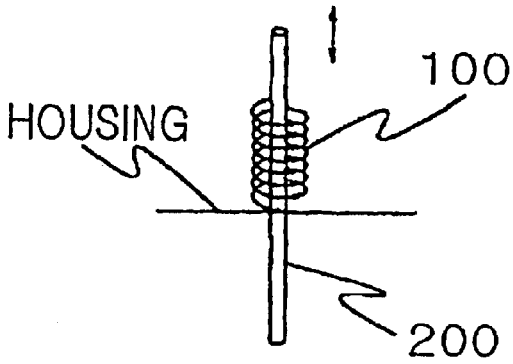
FIGS. 10*a* to 10*c* are views showing three kinds of antennas classified according to the structure of the antenna.
Figure 10B:
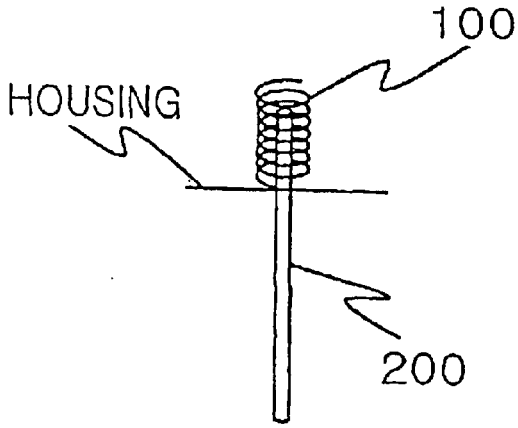
Figure 10C:
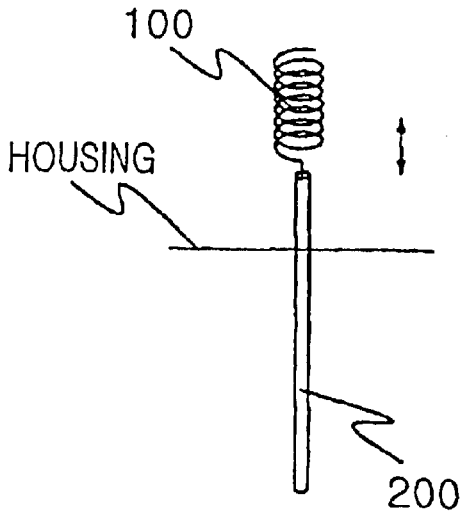

In the present embodiment, the antenna element 3 is fixed to the housing and the radiator 2 moves up and down through the antenna element 3 to be resonated, thereby adjusting the radiating direction and radiating amount of the electromagnetic waves. However, the present invention is not limited to this embodiment and can be widely applied to the various antennas for the portable wireless communication apparatuses. For example, in the antenna structure where the helical antenna part is installed as shown in FIGS. 10*a* to 10*c*, when the antenna element is used in place of the helical antenna part, the antenna has directional properties.

Further, for the antenna structure in which the antenna element 3 and the linear radiator 2 are fixedly attached to the housing in parallel and the structure in which the antenna element 3 is attached to the upper portion of the linear radiator 2 moving up and down and is connected in parallel with the linear radiator 2, the antenna element 3 is resonated as described above, so the gain and radiating characteristics of the antenna are varied depending on the shape, area, position and number of the opening 32*a*. Therefore, the radiating direction and radiating amount of the electromagnetic waves can be adjusted by varying the shape, area, position and number of the openings 32*a*.

As described above, the present invention is directed to provide an antenna for portable wireless communication apparatuses, which is comprised of an antenna element for providing electromagnetic waves with directional properties in place of the conventional helical antenna part for generating non-directional electromagnetic waves, and a linear radiator supplied with power and connected in parallel with the antenna element, thereby preventing the electromagnetic waves generated by portable wireless communication apparatuses from doing harm to users, and increasing the efficiency of the antenna.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An antenna for portable wireless communication apparatuses, comprising:

a linear radiator; and an antenna element, provided on its outer surface with a conductor having one or more openings and on an outer portion of an interior of the conductor with a dielectric material, and connected in parallel with the linear radiator in an insulated state, thereby radiating electromagnetic waves and at the same time being capable of adjusting the radiated amount and direction of the electromagnetic waves.

2. The antenna according to claim 1, wherein said linear radiator is inserted into said antenna element while both the linear radiator and the antenna element are fixedly attached to the housing.

3. The antenna according to claim 1, wherein said linear radiator is on its upper portion connected in parallel with the antenna element.

4. The antenna according to claim 1, wherein said openings are each formed in one of an elongated shape, a rectangular shape and a triangular shape.

5. The antenna according to claim 1, wherein said openings each have a butterfly shape.

6. The antenna according to claim 1, wherein said openings are two or more openings equal to each other in form and size and positioned on a circumferential surface of the conductor at desired intervals.

7. The antenna according to claim 1, wherein said openings are two or more openings, equal to each other in size, different from each other in form and positioned on a circumferential surface of the conductor at desired intervals.

8. The antenna according to claim 1, wherein said openings are two or more openings, equal to each other in form and different from each other in size and positioned on a circumferential surface of the conductor at desired intervals.

9. The antenna according to claim 1, wherein said openings are two or more openings, equal to each other in form and size, different from each other in position and formed at desired intervals.

10. The antenna according to claim 1, wherein said openings are two or more openings, different from each other in form, size and position.

11. The antenna according to claim 1, wherein said dielectric material is plated on its outer surface with a conductive metal.

12. The antenna according to claim 1, wherein said dielectric material is coated on its outer surface with a printed circuit substrate.

* * * * *